US007013669B2

(12) United States Patent
Ophir et al.

(10) Patent No.: US 7,013,669 B2
(45) Date of Patent: Mar. 21, 2006

(54) ARRANGEMENT FOR MULTI-STAGE HEAT PUMP ASSEMBLY

(75) Inventors: Avraham Ophir, Herzliya (IL); Henrikh Rojanskiy, Or Akiva (IL); Arie Kanievski, Kfar Saba (IL)

(73) Assignee: I.D.E. Technologies, Ltd., Raanana (IL)

( * ) Notice: Subject to any disclaimer, the term of this patent is extended or adjusted under 35 U.S.C. 154(b) by 0 days.

(21) Appl. No.: 10/311,620

(22) PCT Filed: Feb. 28, 2001

(86) PCT No.: PCT/IL01/00186

§ 371 (c)(1),
(2), (4) Date: Sep. 11, 2003

(87) PCT Pub. No.: WO01/98665

PCT Pub. Date: Dec. 27, 2001

(65) Prior Publication Data

US 2004/0050090 A1 Mar. 18, 2004

(30) Foreign Application Priority Data

Jun. 22, 2000 (IL) ..... 136921

(51) Int. Cl.

| | |
|---|---|
| ***F25D 9/00*** | (2006.01) |
| ***F28C 1/00*** | (2006.01) |
| ***F04B 25/00*** | (2006.01) |
| ***F04B 3/00*** | (2006.01) |

(52) U.S. Cl. ..... 62/401; 62/121; 62/314; 417/247

(58) Field of Classification Search ..... 62/401, 62/121, 304, 314, 86; 417/247
See application file for complete search history.

(56) References Cited

U.S. PATENT DOCUMENTS

| | | | | |
|---|---|---|---|---|
| 2,674,404 | A * | 4/1954 | Wieseman | 417/423.14 |
| 2,746,269 | A * | 5/1956 | Moody | 62/505 |
| 2,770,106 | A * | 11/1956 | Moody | 62/505 |
| 2,793,506 | A * | 5/1957 | Moody | 62/505 |
| 3,011,322 | A * | 12/1961 | Tanzberger et al. | 62/196.2 |
| 3,165,905 | A * | 1/1965 | Ware | 62/219 |
| 3,447,335 | A * | 6/1969 | Wheeler et al. | 62/159 |

(Continued)

FOREIGN PATENT DOCUMENTS

CH 102 821 A 1/1924

(Continued)

*Primary Examiner*—William C. Doerrler
(74) *Attorney, Agent, or Firm*—Birch, Stewart, Kolasch & Birch, LLP

(57) ABSTRACT

A gasdynamic arrangement for a multi-stage centrifugal turbomachine, such as a two-stage compressor, comprising two coaxial impellers assembled on a common shaft with axial intake ports and radial peripheral discharge zones, the intake ports of the two impellers preferably pointing away from each other; a cylindrical vessel concentrically housing the impellers and the intake duct; a partition wall between the two impellers having a first and a second group of apertures; a first array of curved ducts conveying the flow from the first impeller discharge zone to the first group of apertures in the partition wall, the flow further passing through a chamber in the vessel to the intake port of the second impeller, and a second array of curved ducts conveying the flow from the second impeller discharge zone to the second group of apertures in the partition wall, the flow further going to the discharge port, the two flows bypassing each other in opposing directions at the partition wall.

15 Claims, 3 Drawing Sheets

U.S. PATENT DOCUMENTS

| | | | | | |
|---|---|---|---|---|---|
| 4,125,345 | A | * | 11/1978 | Yoshinaga et al. | 417/243 |
| 4,454,720 | A | | 6/1984 | Leibowitz | |
| 4,896,515 | A | | 1/1990 | Endou | |
| 5,520,008 | A | | 5/1996 | Ophir et al. | |
| 5,857,348 | A | * | 1/1999 | Conry | 62/209 |

FOREIGN PATENT DOCUMENTS

| | | | |
|---|---|---|---|
| CH | 252 609 | A | 1/1948 |
| DE | 1 803 958 | A | 6/1969 |
| FR | 932 307 | A | 3/1948 |

* cited by examiner

ARRANGEMENT FOR MULTI-STAGE HEAT PUMP ASSEMBLY

This application is the national phase under 35 U.S.C. Å 371 of PCT International Application No. PCT/IL01/00186 which has an International filing date of Feb. 28, 2001, which designated the United States of America.

FIELD OF THE INVENTION

This invention relates generally to gasdynamic schemes in turbomachines such as centrifugal compressors used in heat pumps, and more particularly to compact gasdynamic arrangements for high-capacity multistage centrifugal compressors working with water vapor.

STATUS OF PRIOR ART

Various industrial applications, e.g. desalination, water chilling, and ice-making, require massive production of cold, i.e. cooling large quantities of air, water or other coolant. A known method of absorbing heat, when water is used as coolant, is boiling the coolant water under reduced pressure at the respective low temperature. In order to dispose of the heat contained in the evaporated water, the vapor must be brought to higher temperature and pressure by suitable thermodynamic process and finally be condensed transferring the heat to an available heat sink such as water from a cooling tower. The temperature difference between the compressed vapor and the heat sink, plus some additional temperature drop needed to drive the dynamic heat transfer, all expressed in units of the saturated water vapor at those temperatures, determine the compression ratio (CR) of the compressor powering this process.

From the viewpoint of economics, it is desirable to employ the compression process in a single-stage compressor. But when by reason of various design considerations, a single-stage compressor is impractical, it is then the practice to use two or more compressor stages in series, as disclosed in the U.S. Pat. No. 5,520,008 to Ophir et al. Implementing intercooling of the gas/vapor between stages raises the thermodynamic efficiency of the operation and lowers the consumption of mechanical power.

In the heat pump assembly described in the Ophir et al. patent, use is made of a pair of individual centrifugal compressor units, each having its own impeller shaft and a bearing house therefor, as well as its own motor to drive the shaft. In this arrangement, the two motors are placed on opposite sides of the compressor chamber.

In a multi-stage centrifugal compressor in which the stages are assembled in series, the geometries of the vapor passages must be carefully designed so as to convey in an energy-efficient manner the partially compressed vapors from the discharge zone of a preceding stage at the periphery of its impeller to the central intake port of the succeeding stage. Often, intercooling of vapors between the stages is required in order to attain optimum thermodynamic efficiences. These requirements further complicate the geometry of the vapor passages, and also enlarge the physical dimensions and cost of the heat pump assembly. This is especially true of high throughput heat pump units of large diameters.

Such machines as in U.S. Pat. No. 5,520,008 have been built and are operating well, but a more compact solution is very desirable, in order to reduce cost and facilitate installation and maintenance work in confined spaces, such as service basements and galleries of large hotels, office buildings, shopping centers, etc.

A more compact arrangement is disclosed in DE 1803958A describing a two-stage turbomachine (compressor) with intermediate heat exchangers where the impellers of the two stages are disposed coaxially opposite to each other and constitute one body. The intake duct of the turbomachine is a cylinder or conical pipe coaxial with the impellers and is disposed at the side of the first stage. The discharge flow of the first stage is conveyed by a plurality of first discharge ducts to an annular heat exchanger coaxial with the impellers, embracing the intake duct and disposed also at the side of the first stage. Then the flow makes a sharp turn by 180° into a peripheral annular channel embracing the heat exchanger and is directed to the intake port of the second stage. The discharge flow of the second stage is conveyed by a plurality of second discharge ducts to another annular coaxial heat exchanger ending with a discharge port and disposed between the intake duct and the first heat exchanger, also at the side of the first stage. This arrangement places four coaxial flows and two heat exchanger volumes at one side of the impeller group, which involves high hydraulic losses.

CH 102821 discloses a four-stage turbomachine (compressor) with two parallel shafts driven by one motor by means of a gearbox. The first and the second stage impellers are on one shaft, in opposition, while the third and the fourth stage impellers are on a second shaft. The intake duct is disposed laterally to the first shaft. The discharge duct of the first stage conveys the flow from the periphery of the first impeller to the intake of the second stage along a path approximately following the surface of a torus coaxial with the first shaft, while the discharge flow of the second stage is gathered in a space defined by the same torus and conveyed via one lateral pipe to the intake of the third stage coaxial with the second shaft. This arrangement is asymmetric and does not accommodate heat exchangers or other elements in the flow path between coaxial stages.

SUMMARY OF THE INVENTION

In view of the foregoing, the main object of the invention is to provide novel gasdynamic arrangements particularly suitable for building economically feasible, compact and efficient turbomachines such as multi-stage, high-compression, high-throughput gas or vapor centrifugal compressors for heat pumps, and a novel design of a heat pump particularly suitable for use with such compressors.

In accordance with a first aspect of the present invention there is provided a gasdynamic arrangement for a multi-stage centrifugal turbomachine having an intake duct and a discharge port, comprising:

- two impellers with axial intake ports and radial peripheral discharge zones, the intake port of the first impeller being in fluid communication with the intake duct, the two impellers being located at two sides of an imaginary plane crossing their common axis;
- a first means for conducting the flow from the peripheral discharge zone of the first impeller to the intake port of the second impeller along a first flow path including a plurality of first curved ducts in axysimmetric arrangement;
- a second means for conducting the flow from the peripheral discharge zone of the second impeller towards the discharge port of the machine along a second flow path including a plurality of second curved cuts in axysimmetric arrangement;
- wherein the first and the second paths leave the respective peripheral discharge zones bending gradually towards the imaginary plane, cross the imaginary plane in opposite directions and, after the crossing, the two flow paths lie entirely at different sides of the imaginary plane.

In a particular embodiment of a two-stage compressor the gasdynamic arrangement comprises:

- two coaxial impellers assembled on a common shaft, the intake ports of the impellers preferably pointing away from each other;
- a cylindrical vessel concentrically housing the impellers and the intake duct;
- a partition wall between the two impellers having a first and a second group of apertures;
- a first array of curved ducts conveying the flow from the first impeller discharge zone to the first group of apertures in the partition wall, the flow further passing through a chamber in the vessel to the intake port of the second impeller, and a second array of curved ducts conveying the flow from the second impeller discharge zone to the second group of apertures in the partition wall, the flow further going to the discharge port, the two flows bypassing each other in opposing directions at the partition wall.

In accordance with a second aspect of the present invention, there is provided a gasdynamic arrangement comprising an annular condenser chamber disposed concentrically around an intake duct within a heat pump assembly.

Both aspects are aimed at the development of more compact turbomachine designs. In the implementation of the arrangement of the first aspect of the present invention in a two-stage compressor, this is achieved by the usage of a short common shaft supported by a single bearing house situated between the impellers (stages) and driven by a single motor. In the implementation of the arrangement of the second aspect of the present invention in a heat pump assembly, this is achieved by a reduction of the assembly overall length. The employment of both gasdynamic arrangements provides for a highly integrated heat pump assembly, wherein all functional components of the system with the possible exception of the driving motor—multiple compressor stages, evaporator, condenser, intercooling and mist-elimination equipment—are incorporated within a single cylindrical vessel without external ducts. The assembly is characterized by reduced gas/vapor pressure losses, thereby improving the compression ratio and enhancing heat pump economy. The cost of manufacturing this integrated heat pump assembly is considerably lower than the cost of manufacturing an assembly having the same capacity composed of separate units with interconnecting external ducts. The structured configuration of the integrated assembly greatly simplifies its erection at an operating site.

BRIEF DESCRIPTION OF THE DRAWINGS

For a better understanding of the invention as well as other objects and features thereof, reference is made to the attached drawings wherein.

DESCRIPTION OF THE INVENTION

Figure 1:
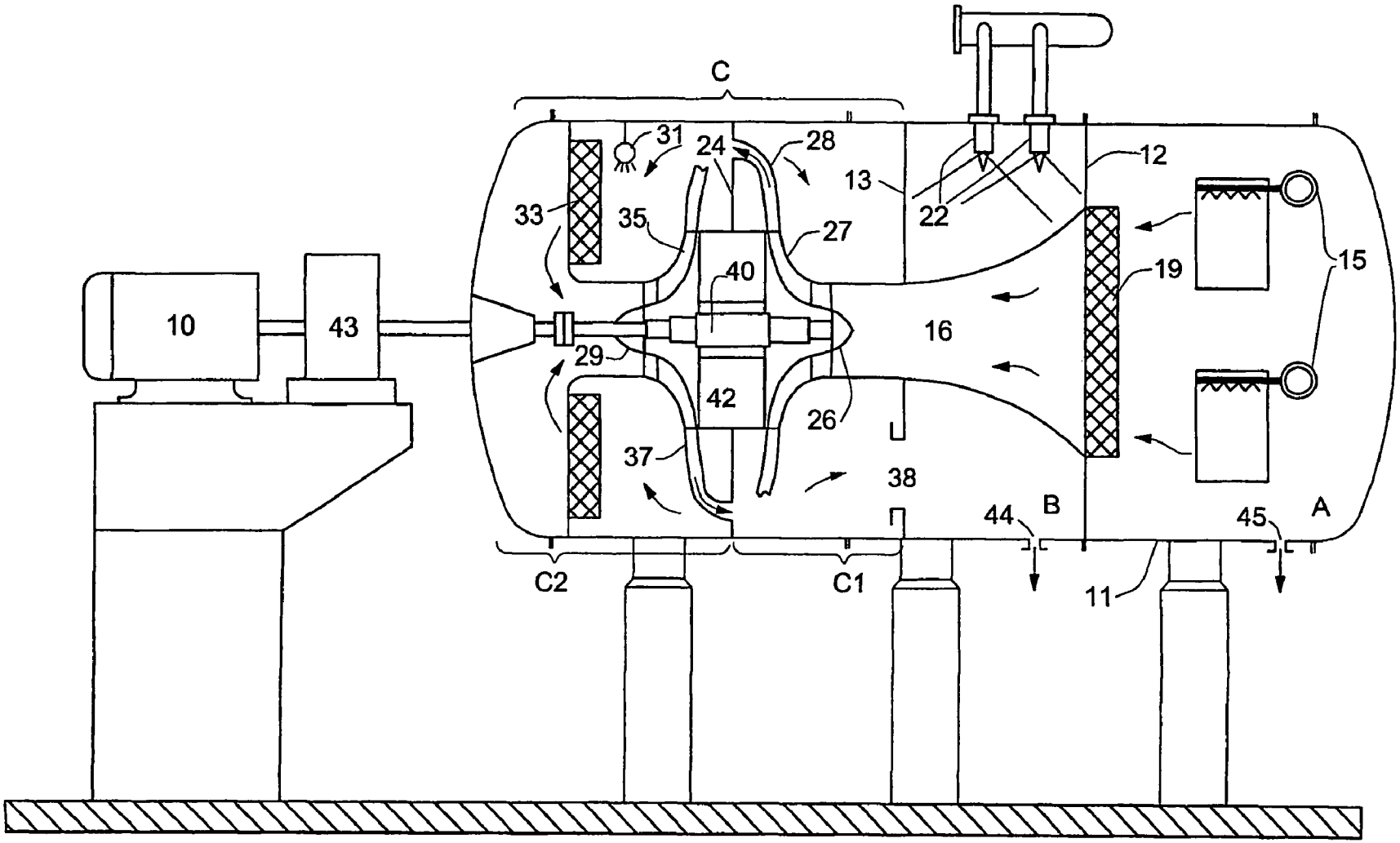
FIG. 1 schematically illustrates one embodiment of a two-stage heat pump assembly in accordance with the invention.

In accordance with a first embodiment of the present invention, a heat pump and a two-sage compressor are shown in FIG. 1. The heat pump is an integrated heat pump assembly based on an gasdynamic arrangement in accordance with the invention, all components of the assembly, except for the motor 10, being contained within a cylindrical vessel 11.

The vessel is divided by partition walls 12 and 13 into an evaporator chamber A, a condenser chamber B and a compressor chamber C. The evaporator chamber A is equipped with headers 15 adapted to spread entrant water or other coolant in thin "curtains" with a large surface area to promote its evaporation under partial vacuum conditions.

Evaporator chamber A opens into an intake duct 16 leading into the intake port of the compressor. The inlet of intake duct 16 is covered by a mist eliminator 19 preventing the entrance of water droplets. Intake duct 16 is coaxial with the cylindrical vessel 11, and, together with partitions 12 and 13, defines the annular condenser chamber B. In the condenser chamber B, there is a plurality of nozzles 22 mounted on the cylindrical wall of the vessel 11 and adapted to spray cooling water into the chamber.

Compressor chamber C houses the first and second stages of a centrifugal compressor, both coaxial with vessel 11. Chamber C is subdivided into two cells C1 and C2 by an intermediate partition wall 24 placed between the two compressor stages. The first stage is provided with an impeller 26 rotatable within a stationary shroud 27 and is adapted to discharge partially compressed vapor through an array of diffuser ducts 28 through partition wall 24 and cell C2 toward the intake port of the second compressor stage impeller 29. The annular cell C2 is equipped with means for intercooling or de-superheating the vapor between the two compressor stages such as water spray nozzles 31. In the flow path to the intake port of the second stage, there is provided a mist eliminator 33.

The second stage impeller 29 is rotatable within a stationary shroud 35 and is adapted to discharge compressed vapor through an array of diffuser ducts 37 and apertures in partition wall 24 into the annular cell C1 of the compressor chamber C which opens into condenser chamber B through a discharge port 38.

Impellers 26 and 29 of the first and second stages of the compressor are mounted on a common shaft 40 supported by a bearing house 42 disposed between them. Shaft 40 is coupled to the external motor 10 through a gear box 43. Thus a single motor can concurrently drive both stages of the compressor.

As indicated by arrows, water vapor generated in evaporator chamber A is drawn by a suction force produced by the compressor to the first stage intake via mist eliminator 19 and intake duct 16. The first stage impeller 26 partially compresses the vapor and discharges it to second stage intake via diffuser ducts 28 and cell C2, through mist eliminator 33. In cell C2, partially compressed vapor is de-superheated by cool water sprayed from nozzles 31 or by suitable heat exchange surfaces (not shown in FIG. 1).

The second stage impeller 29 completes vapor compression and sends the vapor to cell C1 of compressor chamber C via diffuser ducts 37. Next, vapor enters annular condenser chamber B and is condensed there by means of cooling water sprayed from nozzles 22. The heated cooling water leaves condenser chamber B through outlet 44. The chilled water is pumped through outlet 45.

Figure 2:
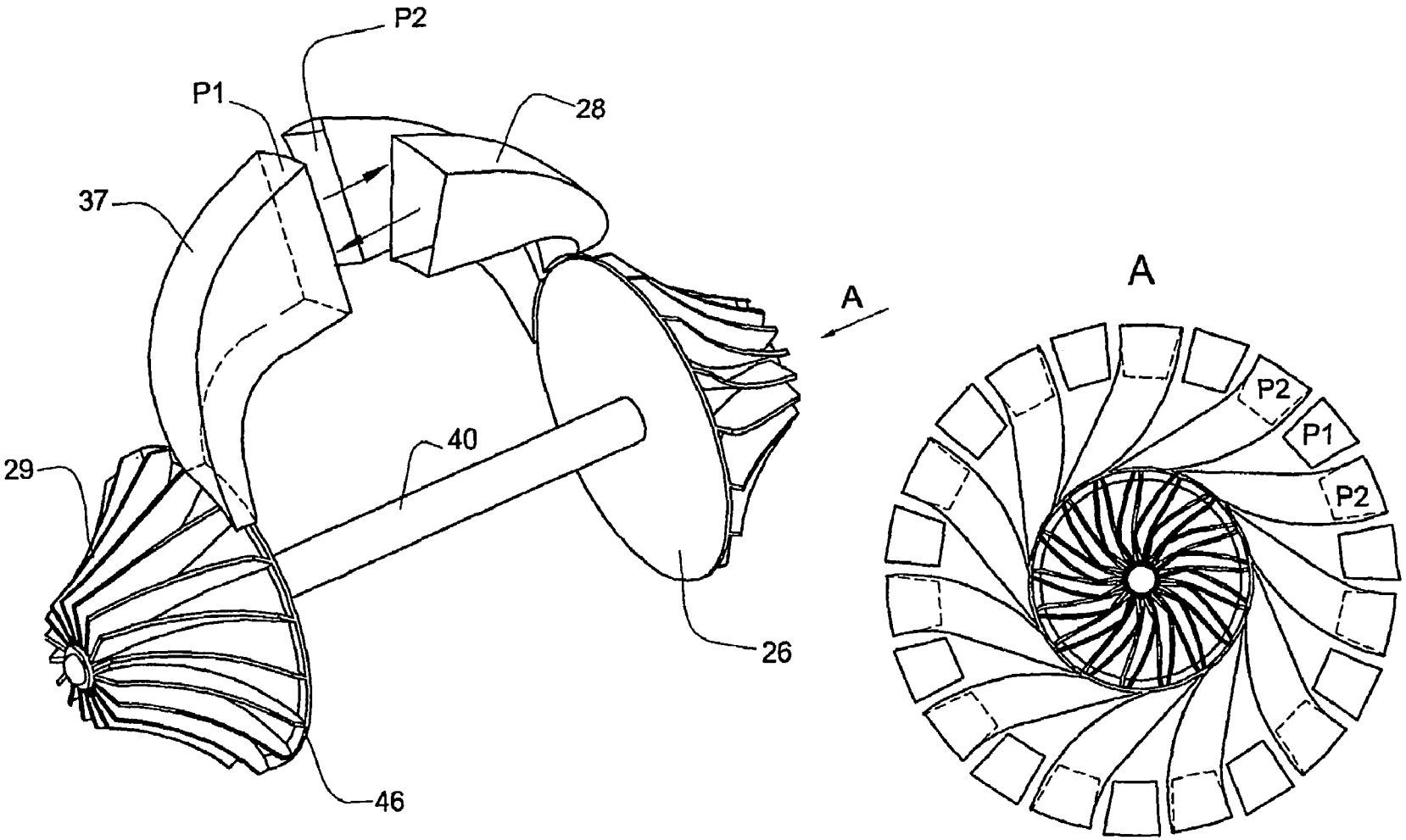
FIG. 2 is a perspective view of the crown arrangement of opposing diffuser ducts and impellers in the two-stage compressor, and FIG. 3 schematically illustrates a second embodiment of the heat pump assembly having three stages.

The flow path of the vapor between compressor stages is organized in a unique gasdynamic arrangement shown in FIG. 2. The discharge of both impellers leaving the shroud in radial direction through the peripheral discharge zone 46 is conveyed by a plurality of curved ducts 28 and 37. Ducts 28 form a crown-like array around the first impeller 26, each duct bending gradually towards partition wall 24 (not shown in FIG. 2) and ending in an aperture P1 in said wall. Ducts 37 form a similar array around the second impeller 29 and also end in apertures P2 on partition wall 24 but from the opposite side. The apertures P1 and P2 are arranged in an alternating pattern on partition wall 24 allowing the opposite vapor flows from the two impellers to bypass each other in a very effective way. Ducts 28 and 37 have a diffuser form, with the cross-section area gradually increasing from impeller periphery 46 to partition wall 24, whereby the vapor flow slows down and its pressure increases.

Reverting to FIG. 1, the vapor stream indicated by arrows greatly slows down in diffuser ducts 37, passes through discharge port 38, and flows into condenser chamber B surrounding the intake duct 16. This gasdynamic arrangement saves space and, together with the above-mentioned mutual by-pass of the impeller discharge flows, allows a very compact and aerodynamically effective layout of the heat pump assembly. The layout is also mechanically effective since the short twin-impeller shaft can be supported by one bearing house and driven by a short shaft line. The whole heat pump assembly with the exception of the motor can thus be accommodated in a simple cylindrical housing of approximately twice the impellers' diameter.

This configuration substantially reduces the cost of manufacturing and installing the assembly, simplifying to a significant degree the erection and maintenance of the assembly at its site of service. It also minimizes gas/vapor pressure losses, thereby improving the compression ratio and the efficiency of the assembly.

The assembly as a whole can be made even more compact by placing a suitably designed electric motor between the two impellers instead of the bearing house, the shaft line and the external motor.

Figure 3:
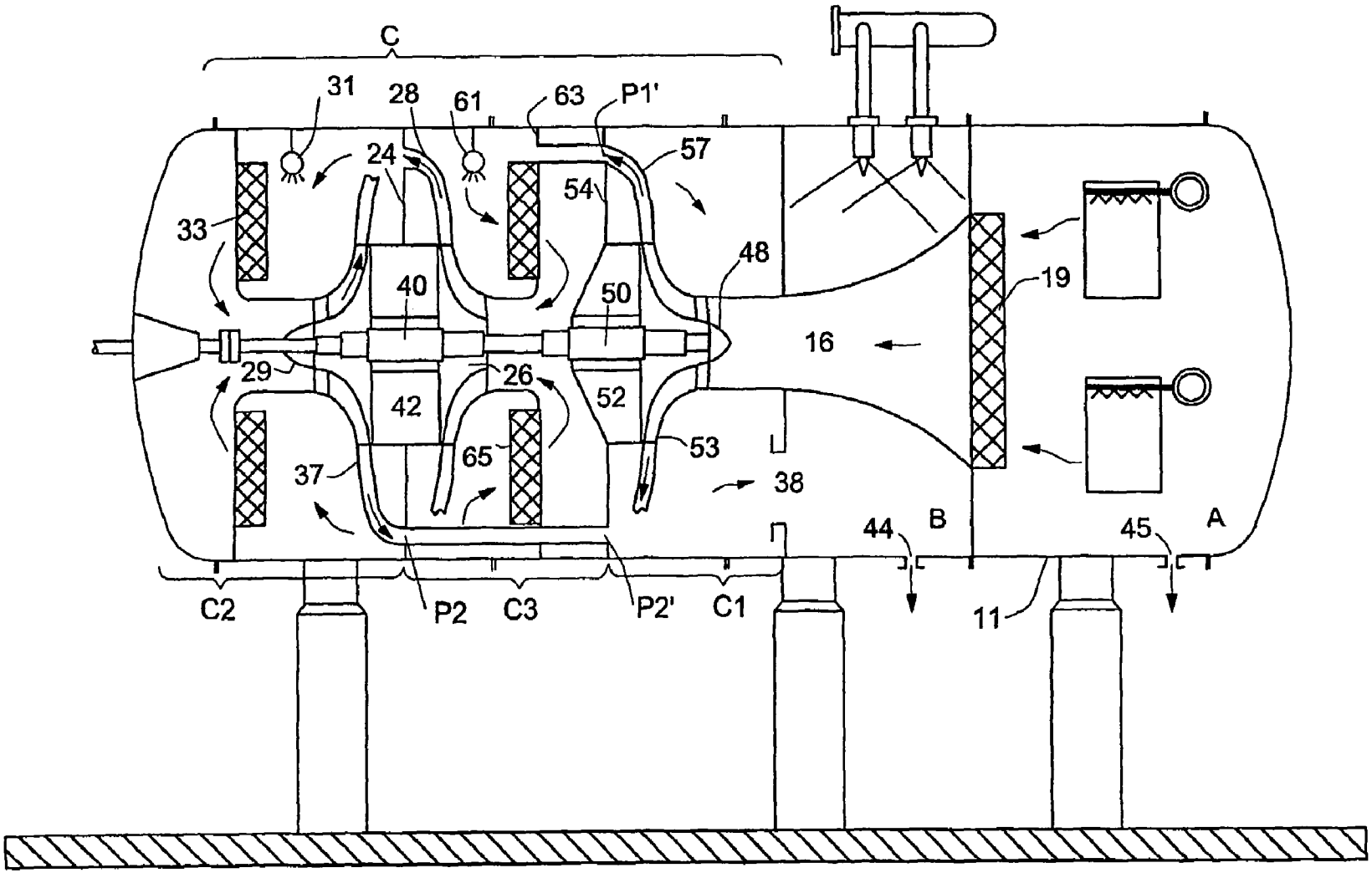

Another embodiment of a heat pump assembly of the present invention is shown in FIG. 3 and demonstrates the manner in which a two-stage compressor may be expanded to three stages and more. The arrangement is identical to that shown in FIG. 1 except that it includes a third compressor stage introduced next to intake duct 16. Impeller 48 of the third stage is mounted on an extension 50 of drive shaft 40, which extension is supported by a second bearing house 52 coaxial with the cylindrical vessel 11. Impeller 48 is rotatable in a shroud 53.

A second partition wall 54 is introduced, with apertures P1' and P2' similar to apertures in partition wall 24. The peripheral discharge zone of impeller 48 is connected to apertures P1' on partition wall 54 by a crown-like array of diffuser ducts 57 similar to ducts 28. Ducts 37, from the peripheral discharge zone of second impeller 29 to apertures P2 on partition wall 24, are extended to apertures P2' on the second partition wall 54.

A new cell C3 is defined between partition walls 24 and 54 adapted to convey compressed vapor from third stage impeller 48 via diffuser ducts 57 to the intake port of first stage impeller 26. Intercooling spray heads 61 may be accommodated in the new cell C3, in which case an intermediate partition wall 63 carrying mist eliminators 65 is introduced in the flow path, and diffuser ducts 57 are extended to intermediate partition wall 63.

From gasdynamic point of view, impellers 48, 26, and 29 should now be designated first, second, and third stage impellers, respectively. It can be readily seen from the above that more stages may be introduced in exactly the same manner downstream of intake duct 16.

While there have been shown preferred embodiments of the invention, it is to be understood that many changes may be made therein without departing from the spirit of the invention. Thus, the assembly, instead of containing within the cylindrical vessel a multi-stage centrifugal compressor, may contain in concentric relation with the vessel a single stage compressor.

What is claimed is:

1. Gasdynamic arrangement for a multi-stage centrifugal turbomachine having an intake duct (16) and a discharge port (38), and comprising:

a) a first impeller (26) with axial intake port and radial peripheral discharge zone, said axial intake port being in fluid communication with said intake duct;

b) a second impeller (29) with axial intake port and radial peripheral discharge zone, said second impeller disposed coaxially with said first impeller, the two impellers being located at two sides of an imaginary plane crossing their common axis;

c) a first means for conducting the flow from the peripheral discharge zone of the first impeller to the intake port of the second impeller along a first flow path (28, C2) including a plurality of first curved ducts (28) in axisymmetric arrangement;

d) a second means for conducting the flow from the peripheral discharge zone of the second impeller towards said discharge port of the machine along a second flow path (37, C1) including a plurality of second curved ducts (37) in axisymmetric arrangement;

wherein said first and said second flow paths (28, 37) leave the respective peripheral discharge zones bending gradually towards said imaginary plane, said first and said second flow paths cross said imaginary plane in opposite directions and, after crossing said imaginary plane, the two flow paths lie entirely at different sides of the imaginary plane, and wherein said first and said second curved ducts (28, 37) have diffuser shape with cross-section area increasing from the impeller periphery discharge zone to said imaginary plane.

2. Gasdynamic arrangement according to claim 1, comprising a partition wall (24) between said impellers (26, 29), said wall lying substantially in said imaginary plane and having a plurality of first apertures (P1) and a plurality of second apertures (P2), wherein:

a) said plurality of first curved ducts (28) connects the peripheral discharge zone of the first impeller (26) to said plurality of first apertures P1, and said first means for conducting the flow further comprises a first outer shell (C1) defining, together with said partition wall (24), a chamber conducting the flow from said plurality of first apertures P1 to the intake of the second impeller (29), said chamber at least partially encompassing said second impeller;

b) said plurality of second curved ducts (37) connects the peripheral discharge zone of the second impeller (29) to said plurality of second apertures (P2), and said second means for conducting the flow further comprises a second outer shell (C2) defining, together with said partition wall (24), a chamber conducting the flow from said plurality of second apertures (P2) towards said discharge port (38).

3. Gasdynamic arrangement according to claim 2, wherein:

a) said plurality of first curved ducts (28) are arranged in a first crown array around the first impeller (26);

b) said plurality of second curved ducts (37) are arranged in a second crown array around the second impeller (29);

c) said plurality of first apertures (P1) on the partition wall (24) connected to the plurality of first curved ducts (28) are positioned in alternating pattern between said plurality of second apertures (P2) connected to the plurality of second curved ducts (37).

4. Gasdynamic arrangement according to claim 2, wherein said turbomachine is encased in a substantially integral axisymmetric shell (C) coaxial with said impellers (26, 29), said first and second outer shells (C1, C2) being part of said integral shell.

5. Gasdynamic arrangement according to claim 4, wherein said discharge port (38) of the turbomachine is located substantially at the same side of said integral shell (C) as the inlet of said intake duct (16).

6. Gasdynamic arrangement according to claim 4, wherein said integral axisymmetric shell (C) is formed as a cylinder with diameter approximately twice the diameter of the impellers.

7. Gasdynamic arrangement for a multi-stage centrifugal turbomachine according to claim 2, wherein said fluid communication between the intake port of the first impeller (26) and the intake duct (16) is performed via at least one additional stage in the following way:

a) an additional impeller (48) having an axial intake port and a radial peripheral discharge zone is disposed coaxially between said intake duct and said intake port of the first impeller, the intake port of the additional impeller being at the side of and connected to the intake duct (16);

b) an additional partition wall (54) with a plurality of first apertures (P1') and a plurality of second apertures (P2') is situated between the additional impeller (48) and the intake port of the first impeller in a plane perpendicular to the axis of the impellers;

c) an additional plurality of curved ducts (57) is added to connect the peripheral discharge zone of the additional impeller to said plurality of first apertures (P1') on the additional partition wall (54);

d) said plurality of second curved ducts (37) connecting the peripheral discharge zone of the second impeller (29) to the plurality of second apertures (P2) in the existing partition wall (24) is extended to the plurality of second apertures (P2') in the additional partition wall (54).

8. A multi-stage centrifugal compressor having the gasdynamic arrangement for multi-stage turbomachine according to claim 1.

9. A two-stage centrifugal compressor according to claim 8, wherein said first and second impeller are mounted on a common impeller shaft (40) adapted to be driven by one motor (10).

10. A two-stage centrifugal compressor according to claim 9, wherein said impeller shaft (40) is supported by one bearing house (42) disposed between said first and second impellers.

11. A two-stage centrifugal compressor according to claim 9, wherein said common impeller shaft is the shaft of said motor, said impellers being mounted on the two ends of said shaft.

12. A heat pump comprising a two-stage centrifugal compressor according to claim 8 with an intake duct (16), a discharge port (38), and a driving motor (10), the heat pump further comprising an evaporation chamber (A), in fluid connection with said intake duct, and a condenser chamber (B), in fluid connection with said discharge port, and an integral axisymmetric housing (11) coaxial with the compressor, accommodating all elements of said pump or all elements except for the driving motor.

13. A heat pump according to claim 12, wherein said integral housing (11) is divided into chambers by transverse separation walls (12, 13), said chambers being arranged in the following order along the axis of the housing:

a) evaporator chamber (A), b) condenser chamber (B) surrounding said intake duct (16), c) compressor chamber (C), the evaporator chamber (A) being opened towards the intake duct (16), the discharge port (38) of said two-stage compressor being opened towards said condenser chamber (B).

14. A heat pump according to claim 13, wherein said heat pump comprises further:

means (15) to feed water into said evaporator chamber;

means (22) to spray water into said condenser chamber;

means (45) to pump out chilled water;

means (44) to pump out heated cooling water;

and at least one of the following devices:

means (33) for mist elimination situated prior to flow entry into impeller intake ports;

means (31) for intercooling the compressed gas situated in the flow path between said impellers.

15. A heat pump according to claim 12, wherein said condenser chamber (B) is arranged as an annular chamber around said intake duct (16), said discharge port (38) opening into said condenser chamber.

* * * * *